US007040334B2

(12) United States Patent
Pham

(10) Patent No.: US 7,040,334 B2
(45) Date of Patent: May 9, 2006

(54) HEAD AND NECK SUN SHIELD FOR A RECLINING SUNBATHER

(76) Inventor: Helen T. Pham, 17654 Dandelion La., Chino Hills, CA (US) 91709

( * ) Notice: Subject to any disclaimer, the term of this patent is extended or adjusted under 35 U.S.C. 154(b) by 12 days.

(21) Appl. No.: 10/721,035

(22) Filed: Nov. 21, 2003

(65) Prior Publication Data

US 2005/0109383 A1 May 26, 2005

(51) Int. Cl.
*E04H 15/48* (2006.01)

(52) U.S. Cl. ..... 135/143; 135/87; 135/117; 135/148; 135/802; 135/913; 5/418

(58) Field of Classification Search ..... 135/902, 135/906, 913, 148, 153, 154; D30/108, 118
See application file for complete search history.

(56) References Cited

U.S. PATENT DOCUMENTS 957,644 A * 5/1910 Berger ..... 135/144
1,785,953 A * 12/1930 Hanan ..... 5/418
2,036,033 A * 3/1936 Fisher ..... 135/133
2,130,919 A * 9/1938 Erickson et al. ..... 135/141
2,134,879 A * 11/1938 Levy ..... 135/87
2,290,786 A * 7/1942 Varady ..... 5/418
2,464,866 A * 3/1949 Holtz ..... 5/98.1
2,543,597 A * 2/1951 Peery ..... 135/95
2,771,125 A * 11/1956 Dobbins ..... 297/184.15
2,853,088 A * 9/1958 Lamborn ..... 135/132
2,889,838 A * 6/1959 Aviezer et al. ..... 135/154
2,932,833 A * 4/1960 Wambach ..... 5/656
3,011,824 A * 12/1961 Vassallo et al. ..... 296/102
3,174,493 A * 3/1965 Gruenberg ..... 135/143
3,241,160 A * 3/1966 Escobar ..... 5/418
3,255,466 A * 6/1966 Weizer ..... 5/119
3,386,456 A * 6/1968 Walker ..... 135/130
3,404,696 A * 10/1968 De Souza Filho ..... 135/91
3,404,915 A * 10/1968 De Souza Filho ..... 297/17
3,434,843 A * 3/1969 Durst ..... 426/98
3,441,037 A * 4/1969 Transeau ..... 135/97
3,593,997 A * 7/1971 Boehner ..... 473/421
3,651,847 A * 3/1972 Casamassima ..... 383/3
3,847,170 A * 11/1974 Anderson ..... 135/95
4,063,318 A * 12/1977 Nicholson ..... 5/656
4,646,770 A * 3/1987 Lobato ..... 135/137
D294,752 S * 3/1988 Palier ..... D30/118
4,739,784 A * 4/1988 Fast ..... 135/117
4,930,534 A * 6/1990 Hill ..... 135/136
5,088,514 A * 2/1992 House et al. ..... 135/139
5,116,288 A * 5/1992 Kondo et al. ..... 2/171
D335,046 S * 4/1993 Diaz ..... D6/389
5,277,214 A * 1/1994 Tolley ..... 135/133
5,511,259 A * 4/1996 Tarara ..... 5/414
5,513,670 A * 5/1996 Childress et al. ..... 135/154
5,544,671 A * 8/1996 Phillips ..... 135/88.14

(Continued)

FOREIGN PATENT DOCUMENTS

DE 42 14 718 A1 * 11/1993

(Continued)

*Primary Examiner*—Robert Canfield
(74) *Attorney, Agent, or Firm*—David B. Waller & Associates

(57) ABSTRACT

A sun shielding device to protect the head and neck of the user from the sun when lying prone on a relatively flat surface comprising a structural frame having a base support beam and two sides, and a cover means affixed to said structural frame.

8 Claims, 2 Drawing Sheets

U.S. PATENT DOCUMENTS

D374,512 S * 10/1996 Kiley et al. ..... D30/118
5,752,537 A * 5/1998 Kranzler ..... 135/128
5,791,363 A * 8/1998 Moses ..... 135/143
5,839,462 A * 11/1998 Randall ..... 135/128
6,244,286 B1 * 6/2001 Russo ..... 135/128

FOREIGN PATENT DOCUMENTS

GB 2 194 976 A * 3/1988

* cited by examiner

HEAD AND NECK SUN SHIELD FOR A RECLINING SUNBATHER

TECHNICAL FIELD

The present invention relates to devices for protecting the head and neck of a reclining sunbather from the sun, sand and wind.

BACKGROUND OF THE INVENTION

Beach goers and sunbathers often seek protection from the sun's rays, wind and wind blown sand for their faces and necks when in the reclining position. One method of protection is by covering ones head with a beach towel, unfortunately, this is generally uncomfortable making breathing difficult, it interferes with ones ability to read if such is desired and it blocks ones view. Another method employs the use of a beach umbrella unfortunately this often blocks more of the sun's rays than the user desires. In addition, a beach umbrella is difficult to transport and is susceptible to varying wind conditions.

Devises are known to exist for offering limited protection from the sun, such as Lerner, U.S. Pat. No. 4,639,958 and U.S. Pat. No. 4,821,353.

Lerner teaches a sun-shielding device having two configurations. In one configuration the device comprises a stiff skeleton constituting a headrest and a folding cover attached to the stiff skeleton. The skeleton also defines a carrying bag for articles. In the second configuration the device is a carrying case which houses an inflatable pillow and inflatable covering affixed to the exterior of the carrying case. In the first configuration the device is a bag having a skeleton, which cannot be dissembled consequently, the user is required to carry the bag in its fixed configuration. In the second configuration the headrest and the covering is subject to loss of air pressure and puncture. In addition the device's cover will flex in the wind making it difficult to maintain in position. Further, exhausting the air in the chambers is a time-consuming, tedious operation. Both devices under Lerner are subject to being blown away if left unattended because the cover can act as a sail and carry the device away in a stiff wind.

The Neri invention teaches a rectangular beach mat with an integral sunshade. The mat utilizes a boom, two bows and bow string ties to create the tension necessary to partially roll one end of the mat into a sunshield. Unfortunately because this device comprises a mat it is difficult and cumbersome to transport.

Therefore, there is a need for a device that provides a convenient, easily set-up shield to protect against sun, wind and wind-blown sand that is easily transportable and is stable in a breeze.

SUMMARY OF THE INVENTION

The present invention provides a sun shielding device to protect the head and neck of the user from the sun when lying prone on a relatively flat surface. The sun shielding device comprises a structural frame having a base support beam and two sides, and a cover means affixed to the structural frame.

In one embodiment the sides of the device are V-shaped. In this configuration, the sides may comprise a top support beam and a lower support beam joined together at their ends by a connecting means. Preferably the connecting means is a rivet or a nut and bolt that allows the top support beam and the lower support beam to pivot about the sides. In addition the sides may be affixed to one another by a base support beam such that the sides are positioned parallel to each other and 90 degrees to the base support beam. A cover means made preferably of a flexible, minimum-light penetration material may be affixed between the top support beams and between the lower support beams of both sides.

In other embodiments the sun shielding device may further comprise netting affixed between the top support beam and the lower support beam of each of the sides, a head and neck rest that may be removable and/or inflatable and the base may further comprise an anchor means to prevent the sun shield from moving after being positioned in place. Preferably the anchor means comprises at least one stake extending from the base support beam for driving into a relatively flat surface to hold the sun shielding device in place for use. It is further preferable that the at least one stake be retractably affixed to the base support beam so that when retracted, the stake fits flush against the base support beam.

DESCRIPTION OF THE FIGURES

FIG. 2: Is a perspective view of the embodiment represented in FIG. 1.

DETAILED DESCRIPTION

Figure 1A:
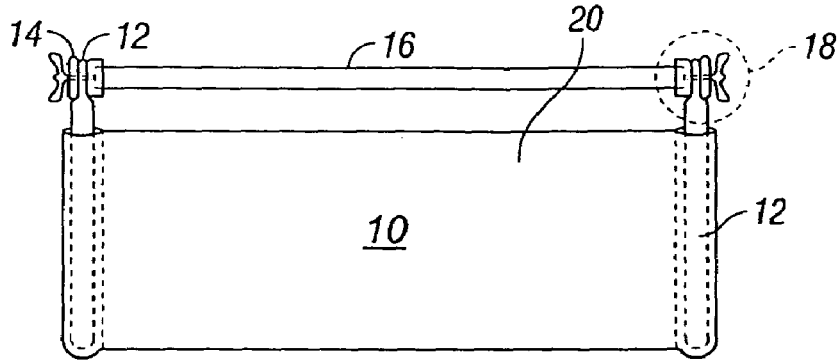
FIGS. 1A–1E are diagrammatic representations of one embodiment of the present invention showing (A) the front view, (B) the back view, (C) the side view, (D) the top view and (E) the bottom view.
Figure 1B:
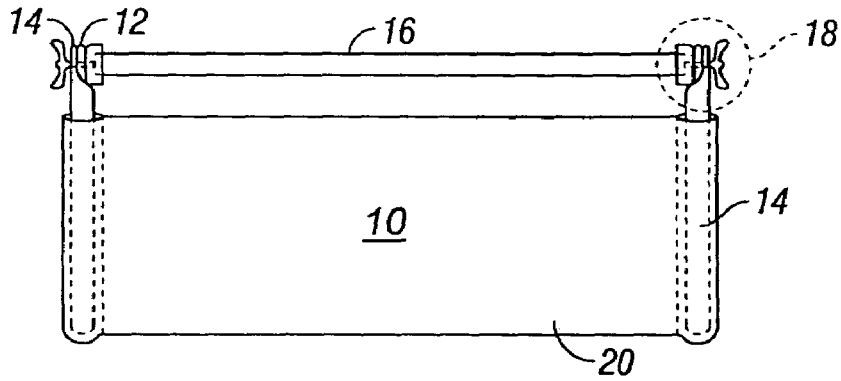
Figure 1C:
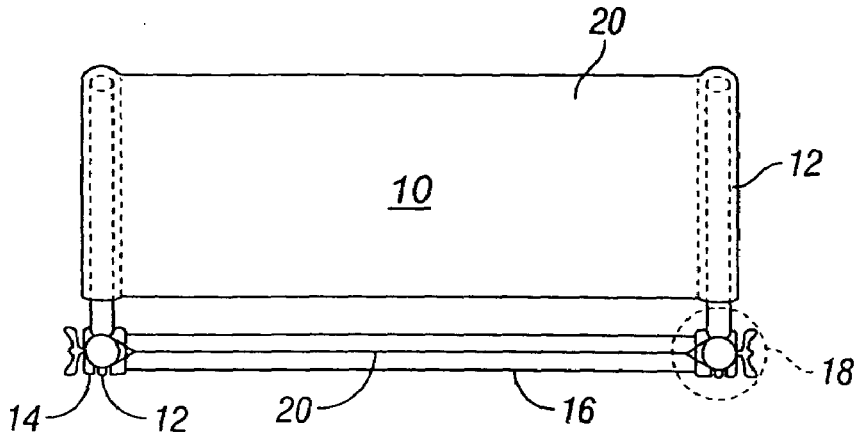
Figure 1D:
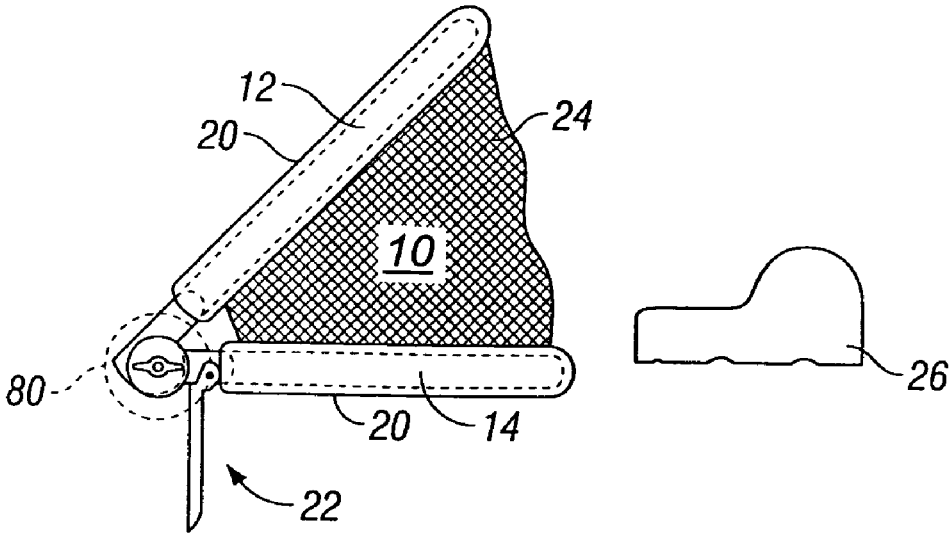
Figure 1E:
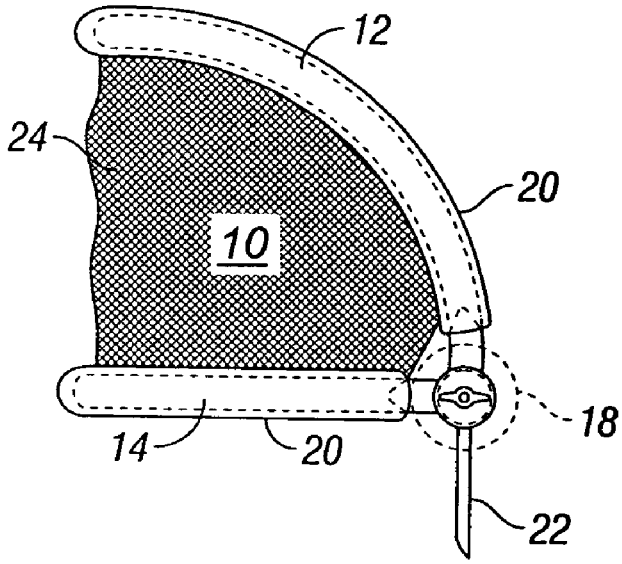

Unless defined otherwise, all terms used herein have the same meaning as are commonly understood by one of skill in the art to which this invention belongs. All patents, patent applications and publications referred to throughout the disclosure herein are incorporated by reference in their entirety. In the event that there is a plurality of definitions for a term herein, those in this section prevail.

The term "affixed" as used herein refers to securing one element of the invention to another element by a variety of methods known to one skilled in the art such as for example providing the cover means with sleeves along opposite sides for slipping over the top or lower support beams.

The term "cover means" as used herein refers to a textile material known to one skilled in the art that such as for example fabric, cloth, canvas or plastic that is durable, lightweight, flexible with minimal light penetration capacity.

The term "connecting means" as used herein refers to a means for hingeably securing one element of the device to another element by a variety of means known to one skilled in the art, such as, for example securing the top support beam 12 to the lower support beam by a rivet or bolt and wing nut.

The term "anchor means" as used herein refers to a a variety of methods known to those in the art for securing the device of the present invention to the relatively flat surface such as for example by utilizing a stake, a tent spike, or other elongated shaft that may be inserted into the sand or ground.

The present invention provides a sun shielding device to protect the head and neck of the user from the sun when lying prone on a relatively flat surface. The sun shielding device comprises a structural frame having a base support beam and two sides, and a cover means affixed to the structural frame.

Structural Frame

The structural frame of the present invention provides the necessary support for the cover means 20 to reduce the amount of sun light contacting the head and neck of the user and to provide a comfortably sized cavity able to accept the head and neck of the user for effective relief from the sun light. A wide variety of structural frame configurations may be utilized to accomplish these functions. In one preferred embodiment the structural frame comprises two sides and a base support beam 16. The sides may be provided as single fixed angle V-shaped structural units or they may be provided as structural units comprising at least two components. When the sides are provided as single fixed angle V-shaped structural units they may be constructed from a single stock material such as a metal tubing bent at a desired angle or by form molding or they may be constructed of two or more pieces permanently affixed together such as for example two tubular shaft joined together at one end by a fixed angle tubing connector. The latter could be constructed easily by one skilled in the art using two lengths of PVC tubing and a 45° tubing connector. Alternatively, the side could be constructed of three pieces. For example, two of the three pieces could be of similar or identical length and the third could be shorter. Using a 90° tubing connector, a longer piece could thereby be connected to the shorter piece, then a 45° tubing connector could be affixed to the free end of the shorter piece and the remaining longer piece could then be affixed to the other end of the 45° tubing connector forming a C-shaped side.

In another embodiment the sides are provided as structural units comprising at least two components affixed by a connecting means 18 that allows the degree of the angle to be adjusted. In this configuration the side is comprised of a top support beam 12 and a lower support beam 14 joined at one end by a connecting means 18.

The top support beams 12 of the sides provide a scaffold, or the upper portion of a scaffold, that maintains the covering means, or one of the cover means 20, in place on the sun shielding device 10. One skilled in the art would recognize that the top support beams 12 may be provided in a variety of configurations that would allow the user to recline and utilize the sun shielding effect of the device 10. For example, the top support beam 12 could be constructed of a single piece of stock material or multiple pieces of stock material. If a single piece of stock material is used the top support beam 12 may be linear, arched or bent into a desired shape. The arched or bent configuration may be used to provide increased clearance for the head of the user over a shorter length when compared to using a linear stock material. If the top support beam 12 is provided in multiple pieces the pieces may be connected at various angles to optimize the internal dimensions of the device 10 for the head and neck of the user and for efficient sun shielding. For example, the top support beam 12 may be constructed of three lengths of tubing. In this configuration one length of tubing is affixed to the connecting means 18 at about a 90° angle. The second length of tubing is connected to the first at about a 135° angle and the last piece of tubing is affixed to the second piece of tubing at about a 140° angle. When the top support beam 12 is provided in multiple pieces, they may be permanently affixed together or removably affixed together so that the device 10 may be easily assembled and disassembled.

The length of the top support beam 12 will vary depending on the angle of the side during use, the diameter of an average user's head, the average length from the top of the head to a location on the users upper body desiring protection from the sun, preferably the base of the neck. One skilled in the art may determine the appropriate length of the top support beam 12 by preparing a variety of lengths, affixing them within the device 10 and having the user try each to identify the length for the desired protection from the sun. Correspondingly, one skilled in the art may determine the length for a particular user desiring a device with linear support beams by calculating the diameter of the users head, preferably from the tip of the nose to the back of the head, add approximately 3 to 6 inches to this value which is the distance the user desires from the tip of the nose to the cover means 20 stretched across the two top support beams 12, then determine the length from the tip of the nose to the desire sun protection limit on the upper part of the body, preferably the base of the neck and add this value to the two values above, then multiply this sum by the square root of two. Using this formula a user having a head diameter of approximately 9 inches, with a preferred clearance of four inches and a distance of 6 inches from the tip of the nose to the base of the neck would preferably have a top support beam 12 of approximately 28 inches. Finally one skilled in the art may provide a number of preferred standard lengths for the user to select from during purchase, such as for example providing one size for smaller individuals such as children one for an average sized adult and one larger size for those individuals with larger features. Generally if the top support beams 12 are linear, then the length is preferably not less that about 18 inches and not more than 48 inches in length. Most preferably not less than about 24 inches and not more than 40 inches.

If a curved top device is preferred the top support beam 12 may be form molded, fabricated or bent into an arc or arch. As previously suggested one skilled in the art may determine the appropriate length of the arched top support beam 12 by preparing a variety of lengths, affixing them within the device 10 and having the user try each to identify the length for the desired protection from the sun. Correspondingly, one skilled in the art may determine the length of the arch for the top support beam 12 for a particular user by calculating the diameter of the users head, preferably from the top of the head to the base of the chin, add approximately 3 to 6 inches to this value which is the distance the user desires from the forehead to the cover means 20 stretched across the two top support beams 12, then determine the length of the neck and multiply this value by the square root of two and add this value to the other two, then multiply this sum by two pi and divide by four. Using this formula a user having a head diameter of approximately 9 inches, with a preferred clearance of two inches and a distance of 4 inches from the base of the chin to the base of the neck would preferably have a top support beam 12 of approximately 25 inches. Finally one skilled in the art may provide a number of preferred standard lengths for the user to select from during purchase, such as for example providing one size for smaller individuals such as children one for an average sized adult and one larger size for those individuals with larger features. Generally if the top support beams 12 are arched, they may be not less than about 12 inches and not more than about 36 inches. Most preferably, not less than 20 inches and not more than 32 inches.

The width and diameter of the top support beam 12 will depend on the length of the beam to provide adequate structural support, the desired weight for ease of transport, the configuration of the beam, whether linear or arched, and the material used to construct the beam, whether solid or tubular stock material. If a flexible top support beam 12 is desired a light weight solid stock material may be used such as for example a carbon fiber, polymer, fiberglass or plastic having a diameter of not less than ⅛ inch and not more than ¾ inch. Most preferably about ¼ inch. Alternatively, if a more rigid top support beam 12 is preferred, a light weight tubular stock material having a larger diameter than the flexible solid stock material may be used such as for example aluminum, titanium steel or carbon fiber having a diameter of not less than ¼ inch and not more than 1¼ inch. The width of the tubular stock will depend on the material used to construct the tubing. For example if the material is titanium or steel the width of the tubing may be less than if the tubing were made of aluminum or carbon fiber because titanium and steel have a stronger tensile strength than carbon fiber or aluminum. Consequently a steel or titanium tubing may have a width of, for example, 1/64 inch while the width of an aluminum or carbon fiber tubing may be 1/16 inch to provide an equivalent strength. Preferably, the top support beams 12 are made of aluminum or polymer tubing having a diameter of not less than ½ inch and not greater than 1½ inches, most preferably about ¾ inch having a width of not less than 1/16 inch and not more than ⅛ inch.

The lower support beams 14 in conjunction with the base support beam 16 provide the foundation to support the top support beams 12. The lower support beams 14 may be provided in a variety of shapes including cylindrical or flat and may be provided in a variety of configurations such as linear or arched. If the lower support beams 14 are flat they may have a length longer than, similar to or shorter than that of the top support beams 12. Their width may vary depending on the support desired by the base for the structural frame. For example the width may range from about ½ inch to about 12 inches. Most preferably the width is not less than about ¾ inch and not more than about 6 inches. The centerline of the lower support beams 14 may be centered about the connecting means 18, a larger portion may be shifted toward the center of the device 10 or a larger portion may be shifted away from the center of the device. For example, if the width of the lower support beam 14 is 6 inches and it is centered about the connecting means 18 then approximately 3 of the 6 inches would be directed toward the interior of the device 10 along the plane created by the two lower support beams 14 and the base support beam 16 and approximately 3 inches would be directed toward the exterior of the device 10. Correspondingly, if a larger portion of the lower support beams 14 was shifted toward the center of the device 10 then, for example, 4 or 5 inches may be directed toward the interior of the device along the plane created by the two lower support beams 14. If the lower support beam 14 is cylindrical it is preferably tubular and may be provided in a similar manner as the top support beam 12.

The lower support beam 14 may be made from linear stock material, form molded, fabricated or bent into an arc or arch. One skilled in the art may determine the appropriate length of the lower support beam 14 by preparing a variety of lengths, affixing them within the device 10 and having the user try each to identify the length for the desired stability. Correspondingly, one skilled in the art may determine the length of a linear lower support beam 14 for a particular user by calculating the diameter of the users head, preferably from the tip of the nose to the back of the head, add approximately 3 to 6 inches to this value which is the distance the user desires from the forehead to the cover means 20 stretched across the two top support beams 12, then determine the length from the tip of the nose to the desired sun protection limit on the upper part of the body, preferably the base of the neck and add this value to the two values above. Using this formula a user having a head diameter of approximately 9 inches, with a preferred clearance of four inches and a distance of 6 inches from the tip of the nose to the base of the neck would preferably have a lower support beam 14 of approximately 18 inches.

The width and diameter of a lower support beam 14 will depend on the length of the beam to provide adequate structural support, the desired weight for ease of transport, the configuration of the beam, whether cylindrical or flat and the material used to construct the beam, whether solid or tubular stock material. Preferably the lower support beams 14 are constructed of the same material as the top support beams 12 and are preferably linear in a configuration having the same width, diameter and thickness as the top support beams 12.

In another embodiment, the device 10 comprises only a single lower support beam 14. In this configuration the lower support beam 14 is connected to the base support beam 16 through a adjustable connecting means 18. The shape of the lower support beam 14 is preferably flat having a length similar to the length of the top support beams 12 and a width of not less than 10 inches and not more than 40 inches. Preferably the length is less than the top support beam 12 having a length of not less than 12 inches and not more than 18 inches. The lower support beam 14 in this configuration may be connected to one of the top support beams 12 by a connecting means 18 or may be adjustably connected to the base support beam 16 at a desired position along its length. In a preferred embodiment the lower support beam 14 is connected adjustably to the base support beam 16 at a location close to or at the center of the base support beam 16.

The base support beam 16 is affixed to and provides support for the two sides and determines the desired width of the sun shielding device 10 when the device is in use. The base support beam 16 may be affixed to the sides by a variety of means known to those skilled in the art including, for example, by an adapter provided in either the top support beams 12 or lower support beam 14 allowing the base support beam 16 to be affixed permanently or reversibly. In such a configuration the adapter may provide an aperture to allow the base support beam 16 to be affixed within the aperture by screw thread, press-fit, snap-fit or adhesive. When such an aperture is provided the ends of the base support beam 16 will be correspondingly adapted so that it may be securely affixed within the aperture. Alternatively the adapter may be pins allowing the base support beam 16 to be affixed to the top support beams 12 or lower support beams 14 through apertures provided in the base support beam 16 able to receive the pins. These apertures may be provided horizontally recessed within the ends of the base support beam 16 or may be provided vertically through the side of the base support beam 16. If the apertures are provided vertically it is preferable that the ends of the base support beam 16 be configured to allow for a more secure connection, such as for example, the ends of the base support beam 16 may be flattened and arched to conform closely to the cylindrical shape of the tubular top support beams 12 or lower support beams 14. The pins may be threaded for securing the base support beam 16 by screwing onto the pin or may have holes for securing the base support beam 16 with cotter pins. In another configuration the base support beam 16 may be affixed to the connecting means 18. A variety of methods may be used to affix the base support beam 16 to the connecting means 18 including those disclosed above.

The width and diameter of the base support beam 16 will depend on the length of the beam to provide adequate structural support, the desired weight for ease of transport and the material used to construct the beam, whether solid or tubular stock material. Most preferably the base support beam 16 is constructed of the same material as the lower support beams 14 and is preferably linear in a configuration having the same width, diameter and thickness as the lower support beams 14.

The length of the base support beam 16 may vary depending on the desired width of the sun-shielding device 10. One skilled in the art may determine the appropriate length of the base support beam 16 by preparing a variety of lengths, affixing them within the device 10 and having the user try each to identify the length for the desired protection from the sun. Correspondingly, one skilled in the art may determine the length for a particular user by calculating the diameter of the users head, preferably from side to side, add approximately 6 to 24 inches to this value which is the distance the user desires from the side of the head to the sides of the device 10. Using this formula a user having a head diameter of approximately 9 inches, with a preferred clearance of six inches would preferably have a base support beam 16 of approximately 21 inches. Finally one skilled in the art may provide a number of preferred standard lengths from which the user could select during purchase, such as for example providing one size for smaller individuals such as children one for an average sized adult and one larger size for those individuals with larger features. Generally the length of the base support beam 16 is preferably not less that about 18 inches and not more than 48 inches in length. Most preferably, the length is not less than about 24 inches and not more than 40 inches.

In addition, one skilled in that art could provide lengths of the base support beam 16 for use by more than one user simultaneously. In this case, the length of the base support beam 16 would have to determined based on the shoulder width of the users intending to utilize the sun shielding device 10 simultaneously. For example, if two individuals are intending to use the device 10 simultaneously the length may be determined by measuring the shoulder widths of the two users and adding 3 to 12 inches for the desired separation between them during use. Consequently, if the individuals have shoulder widths of 18 and 20 inches and a desired distance of 10 inches from each other during use the length of the base support beam 16 would be 48 inches. Preferably, if the device 10 is to be used for two people, the base support should be not less than 30 inches and not more than 60 inches long. Most preferably, the base support beam 16 should be approximately 30 to 48 inches long for use by two people.

The sides may be affixed to the base support beam 16 at a variety of desired angles for example the sides may be perpendicular to the base support beam 16 or they may be at an angle greater than or less than 90 degrees. Preferably, the angle is not less than about 75 degrees or more than about 115 degrees. Most preferably, the angle between the base support beam 16 and each side is about 90 degrees. The adapter that allows the base support beam 16 to be affixed securely to the sides may provide this angle. One skilled in the art would recognized that if the sides are adjusted to an angle substantially wider than 90 degrees that the clearance between the cover means 20 affixed to the top support beams 12 and the user will correspondingly decrease. Consequently, the lengths of top support beams 12 may require to be increased to achieve the same desired clearance. Preferably both sides are affixed to the base support beam 16 at the same angle.

Connecting Means

The connecting means 18 serves to affix the top and lower support beams 14 together and to allow the user to maintain a desired angle between the two beams on both sides of the device 10. The connecting means 18 may provide a fixed angle V-shaped configuration or provide an adjustable angle configuration. In the fixed angle configuration the connecting means 18 might be connectors having two receiving ends positioned at a set desired angle such as 45°. To prepare the sides the top support beams 12 and lower support beams 14 are inserted into the receiving ends of the connectors and secured in place. The two beams on each side may be secured in place permanently by for example adhesive or reversibly by for example snap-fit, press-fit or by providing threads within the receiving ends of the connector and on the ends of the top and lower support beams 14.

In the adjustable angle configuration, one skilled in the art would recognize that a variety of configurations allowing for the rotation of the two beams about their joining ends could be provided. For example, the connecting means 18 may be provided by flattening the joining ends of the top and lower support beams 14 parallel to the rotation plane and affixing a rivet or screw with wing nut through an aperture aligned in both flattened joining ends to connect the two beams and allow for some adjustment of the angle produced by the sides. One skilled in the art would recognize that in this configuration the length of the portion of the beam that is flattened and the positioning of the apertures will limit the rotation of the beams. More specifically, if the aperture is located relatively closed to the ends of the beams then the shorter the length of the beam that is flattened the more limited the rotation will be because of the spatial interference that will occur when the nonflattened portions of the beams impact each other. Correspondingly, increasing the length of the flattened portions of the beams will increase the amount of rotation available for adjusting the side angle. One skilled in the art would recognize that a variety of configurations may be utilized that avoid this limitation, such as for example providing a flattened portion on one of the beams, either top or lower that has a width greater than twice the diameter of the beam. A substantial portion of this additional width is provided preferably in one direction from the center of the beam and in the plane created by the joining of the top and lower beams. The aperture is preferably provided in the additional width portion and in alignment with the aperture provided in the beam to be joined when the two beams are held generally parallel with their flattened ends in the same plane. Preferably the beams are joined by a means that allows the beams to be adjusted and secured in place such as by bolt and wing nut affixed through the apertures.

These configurations may further provide a locking means that utilizes a structural element and/or friction to secure the top and lower support beams 14 at a desired angle. This locking means may provide a fixed angle once in place, or alternately, the mechanism may provide an adjustable angle feature. An example of a means to provide a fixed angle is a slotted bar pivotally affixed to the lower support beam 14 at a distance from the point at which the two beams are joined, whereby the top support beam 12 provides a projection that is slidably contained within the slot and the top of the slot contains a notch that when the top support beam 12 is lifted by the user, the projection slips into the notch and is held in place at a fixed angle.

A wide variety of methods that would provide an adjustable angle feature are known to those skilled in the art. An example would include the configuration discussed above for the fixed angle locking means wherein the slotted bar contains a number of notches at a variety of desired angles. In a similar configuration the projection that is slidably contained within the slot is a threaded bolt affixed through the top support beam 12 and affixed within the slot by a wing nut that may be tightened, securing the side at the desired angle. In another configuration, the joining ends of the beams may be provided with flat discs or partial discs parallel to the plane created by the top and lower support beams 14, each beam having an aperture within this disc shaped area aligned so that the two beams may be joined together by, for example, rivet or bolt and wing nut. The discs may further comprise alternating teeth projecting from the surface of the discs and correspondingly positioned indentations to receive those teeth that engage at a predetermined set of desired angles. The bolt may be loosened to shift the discs and adjust the angle, then tightened to maintain the desired angle. Another configuration may comprise a releasable ratchet mechanism with grooves that provides multiple fixed angles between the top support beams 12 and the lower support beams 14.

In a preferred embodiment, the connecting means 18 serves to affix the top and lower support beams 14 together and to allow the user to maintain a desired angle between the two beams on both sides of the device 10 as well as allowing the top support beam 12 and the lower support beam 14 to fold together for ease of transport and storage.

The connecting means 18 may also serve to affix the base support beam 16 to the top and lower support beams 14. In a fixed angle configuration the connecting means 18 might be a connector having three receiving ends, two of the three ends positioned at a set desired angle such as 45° and one receiving end positioned at for example 90° to the plane formed by the other two receiving ends. To prepare the device insert one of the connectors onto each end of the base support beam 16. Adjust the connectors so that one of the remaining receiving ends is parallel to a flat horizontal surface or plane. Then insert one lower support beam 14 into the receiving end of each connector parallel to the horizontal surface and insert the one top support beam 12 into each of the two remaining receiving ends projecting 45° from the horizontal surface. The beams may be secured in place permanently by for example adhesive or reversibly by for example snap-fit, press-fit or by providing threads within the receiving ends of the connector and on the ends of the top and lower support beams 14.

In the adjustable angle configuration, one skilled in the art would recognize that a variety of configurations allowing for the rotation of the two beams about their joining ends with attachment of the base support beam 16 could be provided. For example, the connecting means 18 may be provided in the configuration described above while also providing an attachment means for the base support beam 16 positioned for example at 90° to the sides. The attachment means may be provided in a variety of configurations that allows for permanent or reversible attachment to the sides including for example a receiving cup may be provided on the connecting means 18 having a diameter able to securely receive the base support beam 16. The beams may be secured in place permanently by for example adhesive or reversibly by for example snap-fit, press-fit or by providing threads within the receiving cup of the connector and on the ends of the base support beam 16.

Cover Means

The cover means 20 serves to reduce the amount of sunlight reaching the user's head and neck as well as to provide additional structural support for the device 10. The cover means 20 may be provided in a two piece configuration wherein one cover is affixed between the top support beams 12 and the second cover is affixed between the lower support beams 14. Correspondingly, the cover means 20 may be provide as a single piece affixed to one set of support beams wrapping around the base support beam 16 and then affixed to the remaining set of support beams.

In the two piece configuration, one of the cover means 20 of the sun-shielding device 10 is stretched between and affixed to the top support beams 12 and the other cover means 20 is stretched between and affixed to the lower support beams 14. A variety of methods may be used to permanently of reversibly affix the cover means 20 between the beams. For example if the cover means 20 is permanently affixed to the support beams it may be secured in place by rivets, clips, pins or adhesive. If for example, a reversible method is desired the material that forms the cover means 20 may be looped over and secured upon itself by for example by stitching or with Velcro™ forming a cylinder. The cover means 20 is positioned in place by slipping over the beams. The width of the cylinder may be such that the cover is held relatively planar and rigid across the two beams. Alternatively, the amount of material used to construct the device 10 may be substantially reduced if only the opposing sides of the cover means 20 are looped over forming a sleeve for each support beam having a diameter just larger than the diameter of the support beam to be received.

The length and width of the cover means 20 will depend on the length of the base support beam 16 and the length and width of the support beams receiving the cover means 20. For example, if the cover means 20 is being prepared for a device 10 for a single user 24 inches long with linear top support beams 12, 28 inches in length constructed of 1 inch diameter tubular stock material the cover means 20 would be not more than about 26 inches and not less than about 20 inches in width and not less than about 30 inches and not more than about 50 inches. Preferably the cover is constructed with opposing sleeves along its width to reduce the amount of material needed to prepare the cover means 20. Consequently, in the above example the width of the cover means 20 would be not more than about 26 inches and not less than about 20 inches and not less than about 30 inches and not more than about 35 inches in length.

In a one-piece configuration the cover means 20 is affixed to one set of beams drawn over the base support beam 16 and affixed to the other set of beams. For example the cover means 20 is affixed to and stretched across the two top support beams 12, then wrapped over the base support beam 16 and affixed and stretched across the two lower support beams 14. Preferably, the cover means 20 in this configuration comprises four pockets able to receive the ends of the top support beams and lower support beams 14 formed parallel to each other and in each corner of the cover means 20 with the openings of the pockets facing inward along its length. These pockets may be prepared separately from the cover means 20 and then affixed by for example sewing. Alternatively, the lengthwise edge of the material may be looped over and secured for example by sewing or by using Velcro™ to form the pockets. The amount of material looped over should be sufficient to form a pocket able to receive the ends of the beams used to construct the device 10. For example if the structural support beams are made of 1 inch outer diameter tubing the length of material looped over should not be less than 3.5 inches or the radius of the tubing times 2 times pi plus a sufficient length for an appropriate seam. Openings to provide access to the interior of the pockets may be provided by cutting the looped over material at a distance not less than about 2 inches and not more than about 4 inches from the base of the pockets and parallel to the width of the pocket. One skilled in the art would recognize that the cover means 20 should be constructed so that when it is stretched between beams, there is sufficient tension to maintain its shape, even in windy conditions.

The selection of the material to be utilized with the present device 10 will be based on its flexibility (the ability to be stretched between the beams of the device repeatedly and for long period of time in the sun), durability (the ability to withstand continued use in a salt corrosive and particle abrasive environment), light penetration characteristic (the ability to reduce a desired amount of light rays from passing through the fabric), light weight for ease of transport and ultraviolet light (UV) degradation resistance (the ability to maintain structural integrity over extended periods of time during exposure to sun light). One skilled in the art would recognize that there are a variety of materials currently used for camping, hiking and outdoor sports that would be suitable for preparation of the cover means 20 of the device of the present invention. For example a variety of materials currently used to construct tents may provide the flexibility, durability, minimal weight and UV resistance desired for the sun-shielding device 10. The light penetration characteristic of the cover means 20 will vary depending on the amount of reduction in light the user would received while using the device 10. If the reduction in light desired is greater than 90 percent then a tighter weave possibly heavier material may be preferable such as for example canvas. If the reduction in light is less than 50 percent a looser weave lighter weight material may be selected such as for example drapery shear material.

In another embodiment of the invention, netting 24 is affixed between the top support beam 12 and the lower support beam 14 on each of the sides to provide protection from wind-blown objects, allow the user to visualize persons or objects on either side and to reduce wind resistance from the side of the device 10. The netting 24 may be a tightly woven or loosely woven material, depending on the desire of the user. Preferably, the netting 24 allows relatively free movement of air through the device 10 from side to side and provide for visibility, while still partially blocking the sunlight.

The netting 24 may be provided as part of the device 10 in a variety of ways such as for example as part of the cover means 20 or may be provided separately for attachment to the device 10. If the netting 24 is provided as part of the cover means 20 it may be affixed permanently to the edge of the cover means 20 on the top support beam 12 and permanently affixed to the edge of the cover means 20 on the lower support beam 14. Alternatively the netting 24 may be permanently affixed to the edge of the cover means 20 on the top support beam 12 and reversibly affixed by for example Velcro™ to the lower support beam 14 or visa versa. The netting 24 may be attached by a number of methods known to one skilled in the art, including for example sewing, buttons, snaps, Velcro™, and zippers. Preferably Velcro™ is affixed to the edges of the cover means 20 along the length of the top and/or lower support beams 14 as well as at least one of the edges of the netting 24 material to allow for easy attachment of the side netting 24 to the device 10.

The dimensions of the side netting 24 may vary depending on the angle adjustment provided by the sides. In a fixed angle configuration the netting 24 will have a shape similar to and necessary to enclose the sides. In an adjustable configuration the net may be provided with one or more attachment means to allow for attachment to the top and lower support beams 14 at one or more angle adjustments of the device 10. Alternatively, the material used to construct the netting 24 may have an elastic quality that would allow the net to conform to the one or more angle adjustments of the device 10.

The netting 24 is preferably made of a material that is flexible, durable, light weight and ultraviolet light (UV) degradation resistant such as for example nylon.

Anchor Means

In another embodiment of the invention, the base of the device 10 may further comprises an anchor means 22 to prevent the sun shield from being swept away by the wind after being positioned in place. The anchor means 22 may be provided on the base support beam 16, one or both of the lower support beams 14 and or a combination. In one embodiment, the anchor means 22 comprises at least one stake extending from the base support beam 16 for driving into a relatively flat surface to hold the sun shielding device 10 in place during use. Alternately, the at least one stake may be affixed to one or both lower support beams 14. Preferably, four stakes are used, two positioned along the base support beam 16 at or near the ends and two stakes positioned one each along the lower support beams 14 near or at their ends. Alternatively, all four stakes may be positioned along the lower support beams 14 two on each beam, one stake at or near each end. Most preferably, two stakes are utilized and may be positioned at or near the ends of the base support beam 16. Alternatively, the two stakes may be positioned on the lower support beams 14 at or near the end farthest from the base support beam 16.

In one configuration the stakes may be positioned by providing apertures vertically within the lower and base support beams 16 so that the stakes may be driven into the ground through the device 10 anchoring it to the surface. Alternatively the stakes may be provided on the base and/or lower support beams 14 in a fixed position. In this configuration the stakes may be secured to the base and lower support beams 14 by for example, adhesive, soldering, welding or brazing.

In another configuration the at least one stake is provided on the base or lower support beams 14 in a retractable manner. When not in use the stakes may be rotated to fit flush against the base or lower support beams 14. The shape of the stake may be such that it molds to the shape of the base and or lower support beam 14 when retracted. For example if the base and/or lower support beam 14 is tubular the stake may have a semi-cylindrical shape so that when retracted it folds closely to the cylindrical shape of the tubing.

Alternately, the at least one stake may be positioned at the end of the support beam. When not in use the stake may be rotated parallel with the support beam and then retracted into the tubular support beam. In this instance, the stake is slidably affixed within the tubular beam and in the extended position, is able to pivot perpendicular to the support beam for insertion into the sand or ground.

The stake may be constructed in a variety of shapes known to one skilled in the art that provides a resistance to movement and to uplift in windy conditions. The stake may be made from round, square, or rectangular stock material. It may have straight or tapered sides having a relatively pointed or blunt end. Alternately, the stake may have a narrow diameter shaft with a larger diameter pointed end to provide additional retraction resistance from the surface once inserted. In another configuration, the stake has a narrow shaft with a cup shaped end wherein the base of the cup is relatively pointed. The pointed end allows for easy insertion into a surface while the cup has the ability to fill with dirt or sand and provide increased resistance to removal.

In a preferred embodiment, the stake has a similar shape as the support beam and is rotatably affixed to the support beam's exterior such that it may be retracted by folding parallel to and flush with the support beam to which it is affixed.

The length of the stakes will vary depending on the surface into which the user intends them to be inserted. For example if the surface is relatively dense it may be difficult to drive the stake a significant distance into the surface consequently a shorter length may be desired such as for example not less than about 2 and not more than about 4 inches. Correspondingly if the surface is relatively loose such as for example sand, a longer stake may be desirable such as for example not less than about 4 inches and not more than about 8 inches.

The stake's diameter will vary depending on the material used to construct the stake. Since the stake must withstand being driven into a relatively flat surface on a repeated basis the strength of the material will be essential to prevent damage to the stake. Consequently, materials having substantial tensile strength such as steel may require a lesser diameter width than a weaker tensile strength material such as aluminum. For example, if the material used to prepare the stake is round cylindrical aluminum stock then the stake is preferably not less than about ¼ inch and not more than about ¾ inch. Preferably, the diameter is not less than about ⅜ inch and not more than about ⅝ inch. If however the material is round cylindrical steel stock the stake is preferably not less than about ⅛ inch and not more than about ½ inch. Most preferably the diameter of the steel stake is not less than about 3/16 inch and not more than about ¼ inch.

The stake may be constructed of a variety of materials that provide sufficient strength to allow the stake to be driven into a relatively flat surface with ease and without damaging the stake and are resistant to the corrosive effects of water and salt. For example the stake may be made of metal such as aluminum, titanium, steel, a high-density polymer, carbon fiber or other such durable, lightweight material.

In another aspect, the sun-shielding device 10 further comprises a head and neck rest. The head and neck rest provides a cushion 26 for comfort while reclining. The head and neck rest may be constructed of a variety of materials known to those skilled in the art, for example, a solid flexible material such as composition foam or feathers. Alternatively the head and neck rest may be inflatable providing air as the cushion 26. The dimensions of the head and neck rest will depend on the area of the device 10 receiving the cushion 26 or that area bordered by the two lower support beams 14 and the base support beam as well as the dimensions of the user's head and neck. One skilled in the art would recognize that if the device 10 further comprised a head and neck rest that the additional rise of the head and neck due to the use of the cushion 26 should be factored into the equations provided for the length of the top and lower support beams 14. For example, if the head and neck rest raises the user's head about 2 inches off of the relatively flat surface, this increase may be compensated for by adding this 2 inch distance to the diameter of the user's head dimension in the equation.

Preferably the head and neck rest should be not less than about 12 inches from side to side and not more than about ¾ of the length of the lower support beam 14 from front to back. Most preferably, the head and neck rest is not less than 18 inches from side to side and not more than 24 inches from front to back. The height of the head rest area of the cushion 26 may be lower than the neck rest portion of the cushion 26. The height of the head rest portion is preferably not less than about 2 inches and not more than about 4 inches. The neck rest portion of the cushion 26 is preferably proportional to the height of the head rest portion and may be determined by measuring the distance from a relatively flat surface to the back of the neck while the user is laying on his or her back on the relatively flat surface. If for example this distance is 2 inches and the height of the head rest portion of the cushion 26 is about 2 inches then the neck rest portion of the cushion 26 may be about 4 inches in height.

The head and neck cushion 26 may be provided as an integral part of the device 10 such as forming a portion of the cover means 20 stretched between the two lower support beams 14 or it may be provided separately from the device. Preferably the head and neck rest is removably affixed to the device 10.

Assembly

The present invention may be provided in fully assembled form or in disassembled form to the consumer. Preferably, the manufacturer fabricates the device and markets it in disassembled and packaged form into an easily transportable carrying case, such as a cylindrical case or a fabric pack. Assembly will depend on how the device is constructed. For example if the device is provided with fixed angle sides, then the sides may be attached to the base support beam and the cover means slipped over the top and lower support beams. If the side netting is provided separately from the cover means, they may be affixed to the sides once the cover means is in place. In this configuration it is preferable that the sides are constructed of a relatively flexible material that allows them to be easily compressed and inserted into an easily transportable carrying case.

In another configuration the connecting means may be provided on the lower support beams. To assemble this device the base support beam and the top support beams are affixed to the connecting means on the lower support beams. The cover means is then affixed to the top and lower support beams. If the side netting is provided separately from the cover means they may be affixed to the sides once the cover means is in place.

In another configuration the sides of the device may rotate about the connecting means allowing the top support beams to fold parallel with the lower support beams. To assemble this device the base support beam is affixed to the connecting means joining the top and lower support beams of the sides. The cover means is affixed to the top and lower support beams and the sides are then opened to the desired angle. If the side netting is provided separately from the cover means they may be affixed to the sides once the cover means is in place.

In another configuration the top and lower support beams may be capable of folding onto the base support beam 16 for compact transport and storage. To assemble this device the top and lower support beams are rotated into place from their initial position against the base support beam. The cover means is then affixed to the top and lower support beams. If the side netting is provided separately from the cover means they may be affixed to the sides once the cover means is in place.

Use

The device for shielding the user from the sun, wind and sand could come completely assembled or in disassembled form. Assembling the device may be as described above.

The device may be stored in disassembled form in a case to minimize space requirements and to aid in transporting the device. When using the device, a suitable location is first selected, such as for example, a relatively flat section of sand or ground suitable for sunbathing. The device may then be assembled and positioned on its base and lower support beams. If additional securing is desired, stakes affixed to, or provide with the device, may be driven into the ground to anchor the sun shield. If the top support beams are rotatably affixed to the lower support beams by the connecting means, they may be adjusted to provide the desired amount of light reaching the user. The user may attach the netting to the cover means on the side openings to provide protection from wind-blown objects. If a head and neck rest is desired it may be inflated to a desired comfort level. The assembled device should be positioned to provide shade for the sunbather's head and neck.

What is claimed:

1. A sun shielding device to protect the head and neck of the user from the sun when lying prone on a relatively flat surface comprising: (a) a structural frame having a base support beam and two sides, wherein said two sides comprise a top support beam and a lower support beam, said top support beam and said lower support beam joined together at their ends by an adjustable angle hinge wherein said sides are affixed to one another by said base support beam such that said sides are positioned parallel to each other and about 90 degrees to said base support beam and wherein said top support beams may be adjustably positioned independently of one another and said lower support beams may be adjustably positioned independently of one another and (b) a cover means affixed between said top support beams, between said lower support beams and netting affixed between said top support beam and said lower support beam of each of said sides.

2. The sun shielding device according to claim 1 wherein said sides are V-shaped.

3. The sun shielding device according to claim 1 wherein said cover means is a flexible, minimum-light penetration material.

4. The sun shielding device according to claim 1 wherein said base support beam further comprises an anchor means to prevent said sun shield from moving after being positioned in place.

5. The sun shielding device according to claim 4 wherein said anchor means is at least one stake extending from the base support beam for driving into said relatively flat surface to position said sun shielding device in place for use.

6. The sun shielding device according to claim 5 wherein said at least one stake is retractably affixed to said base support beam so that when retracted said stake fits flush against said base support beam.

7. The sun shielding device according to claim 1 further comprising a head and neck rest.

8. The sun shielding device according to claim 7 wherein said head and neck rest is inflatable.

* * * * *